US010897967B1

(12) United States Patent
Plotner

(10) Patent No.: US 10,897,967 B1
(45) Date of Patent: Jan. 26, 2021

(54) MAGNETIC JEWELRY ATTACHMENT ASSEMBLY

(71) Applicant: Laura A. Plotner, St. Petersburg, FL (US)

(72) Inventor: Laura A. Plotner, St. Petersburg, FL (US)

( * ) Notice: Subject to any disclaimer, the term of this patent is extended or adjusted under 35 U.S.C. 154(b) by 0 days.

(21) Appl. No.: 15/897,273

(22) Filed: Feb. 15, 2018

Related U.S. Application Data

(60) Provisional application No. 62/459,704, filed on Feb. 16, 2017.

(51) Int. Cl.
*A44C 5/20* (2006.01)
*A44C 5/18* (2006.01)

(52) U.S. Cl.
CPC ..... *A44C 5/2057* (2013.01); *A44C 5/185* (2013.01); *A44C 5/2071* (2013.01); *A44D 2200/10* (2013.01); *A44D 2203/00* (2013.01)

(58) Field of Classification Search
CPC ..... A44C 5/2057; A44C 5/185; A44C 5/2071; A44D 2203/00; A44D 2200/12
See application file for complete search history.

(56) References Cited

U.S. PATENT DOCUMENTS 2,615,227 A 10/1952 Hornik
2,648,884 A * 8/1953 Loofboro ..... A44C 5/2071 24/303
3,129,477 A 4/1964 Mizuno
3,919,743 A 11/1975 Cutler
4,991,270 A 2/1991 Aoki
5,008,984 A 4/1991 Levy
5,311,647 A 5/1994 Levy
5,367,891 A * 11/1994 Furuyama ..... A44C 5/2057 24/303
7,726,152 B2 6/2010 Beard
9,101,185 B1 * 8/2015 Greenberg ..... A44C 5/20
9,603,401 B2 * 3/2017 Pruitt ..... A44C 5/2071
10,258,116 B2 * 4/2019 Hashimoto ..... A44C 5/20
2002/0116794 A1 * 8/2002 Hoffman ..... A44B 5/00 24/303
2003/0229974 A1 12/2003 Zemer et al.
2004/0154143 A1 8/2004 Harrell

* cited by examiner

*Primary Examiner* — Robert Sandy
(74) *Attorney, Agent, or Firm* — Glenn E. Gold, P.A.; Glenn E. Gold

(57) ABSTRACT

A jewelry attachment assembly includes a pair of cylindrical cases. One case has a male section including an annular flange with a pair of diametrically opposing radial splines situated on its periphery. The other case has a female section including a hollow sleeve with a shell. The sleeve includes a pair of diametrically opposite channels formed in the shell. Each channel includes an axially extending slot and an adjoining circumferentially extending slot. During assembly, the male section of one case is joined to the female section of the other case by registration of the pair of splines within the pair of circumferential slots by first guiding the splines through the axial slots, then guiding the splines through the circumferential slots. A pair of opposite polarity magnets are housed in the cases and disposed in adjacent relationship to promote magnetic coupling of the cases.

19 Claims, 8 Drawing Sheets

MAGNETIC JEWELRY ATTACHMENT ASSEMBLY

CROSS REFERENCE(S) TO RELATED APPLICATION(S)

This U.S. non-provisional patent application claims the benefit of U.S. provisional patent application No. 62/459,704, filed Feb. 16, 2017, which is hereby incorporated-by-reference herein its entirety.

FIELD OF THE INVENTION

The present invention relates to fastening devices for jewelry, such as bracelets and necklaces, and, more particularly, is concerned with a magnetic jewelry attachment assembly.

BACKGROUND OF THE INVENTION

Jewelry, such as bracelets and necklaces, typically include fastening devices, such as clasps, that affix one end of an open loop to another to close the loop. Elderly persons, as well as many others, with vision or dexterity issues, have a problem engaging and disengaging many jewelry clasps and thus have a particular need for clasps that will make an item of jewelry easier to put on and take off and still have an aesthetically pleasing appearance and be secure when worn.

Jewelry clasps incorporating magnet technology have been proposed to fill this need. One approach to providing a secure, easy to use, and aesthetically pleasing magnetic jewelry clasp is disclosed in U.S. Pat. App. Pub. No. 2003/0229974. The approach involves eliminating the usual mechanical clasp components and instead affixing magnetic clasp components to respective free ends of the band of the item of jewelry. Then, the magnetic clasp components are concealed within a housing affixed to one end of the jewelry band about one of the magnetic clasp components. The housing has an internal recess that is configured to accept the other free end of the band with the other of the magnetic components affixed to it. The housing internal recess is also configured to force the magnetic components into alignment where magnetic attraction occurs that connects them together. The housing may also be configured with external design features to give the aesthetic appearance of a clasp as well as incorporate a mechanical lock to supplement the magnetic lock.

However, the above-described approach introduces a drawback which limits its utility as a viable solution to the problem of providing a suitable magnetic jewelry clasp. The elimination of the original mechanical clasp components and their replacement by the magnetic clasp components directly attached to the jewelry band ends, together with a housing for hiding the new magnetic clasp components, would appear to limit application of this approach to new items of jewelry. It seems unlikely that owners of existing items of jewelry already having conventional mechanical clasps would find such a drastic modification acceptable.

Accordingly, there has been a long-standing, yet unmet, need for a jewelry attachment assembly in the art for an innovation that will overcome the drawbacks of the prior art and the problems that remain unsolved.

SUMMARY OF THE INVENTION

The present invention is directed to an innovation that overcomes the deficiencies of the prior art and the problems that remain unsolved by providing a jewelry attachment assembly. The jewelry attachment assembly includes a first case and a second case, both of generally cylindrical construction. The first case includes, at a mating end, a male section having an annular flange with a pair of diametrically opposite splines that extend in a radial direction. The second case includes, at a mating end, a female section having a hollow sleeve with a shell body that includes a pair of diametrically opposite channels formed in the shell. Each channel includes an axially-directed slot that interconnects with an associated circumferential-directed slot. In operation, the pair of splines are fitted in the pair of channels by first being displaced through a respective axial slot and then by traversing through a respective circumferential slot via a relative rotary movement between the cases. The registration of the pair of splines from the first case within the pair of channels of the second case facilitates a reversible locking engagement between the cases. The assembly is equipped with a pair of opposite polarity magnets housed within respective ones of the cases so that, in the assembled arrangement of the cases, the magnets are situated in close, adjacent proximity to one another to create a magnetic attraction between them that draws the cases together. The first case and the second case are fitted with fastening mechanisms at respective securing ends of the cases, which enable clasps located at free ends of an item of jewelry to fasten onto the first case and the second case and thereby establish a closed loop with the assembled cases.

Accordingly, in an aspect of the present invention, an assembly for use in releasably connecting free ends of an item of jewelry comprises:

a first case and a second case;

the first case having a body including a mating end and a securing end, the body of the first case further including a male section disposed at the mating end of the body, the male section including an annular flange having an interior space defined therein and extending from a main section of the body, the first case body having a cavity in communication with the interior space of the annular flange, the first case further including a pair of splines each extending radially from an outer surface of the annular flange;

the second case having a body including a mating end and a securing end, the body of the second case further including a female section defining the terminus of the mating end, the female section including a sleeve portion having an interior space defined therein that is complementary to the annular flange of the first case to enable the annular flange of the first case to be receivable within the interior space of the sleeve portion;

the sleeve portion of the second case female section including a pair of channels formed therein, each channel having an axial slot and a circumferential slot contiguous with the associated axial slot, each axial slot extending from a rim of the sleeve portion, the circumferential slot of one channel and the circumferential slot of the other channel each extending from its respective axial slot in a common angular direction;

the male section of the first case and the female section of the second case having complementary configurations enabling registration of the pair of splines within the pair of channels during a reversible operational lock mode of the assembly, the registration involving alignment of the pair of splines with the pair of channels, relative axial displacement between the first case and the second case to situate the pair of splines within the axial slots of the pair of channels, and relative rotation between the first case and the second case to situate the pair of splines within the circumferential slots of the pair of channels; and a pair of magnets, one magnet operably disposed in the cavity of the first case body, another magnet operably disposed in the interior space of the sleeve portion of the second case female section and housed in the interior space of the annular flange of the first case male section during the operational lock mode of the assembly.

In another aspect of the invention, an assembly for use in releasably connecting free ends of an item of jewelry comprises:

a first case and a second case;

the first case having a body including a mating end and a securing end, the body of the first case further including a male section disposed at the mating end of the body, the male section including an annular flange having an interior space defined therein and extending from a main section of the body, the first case body having a cavity in communication with the interior space of the annular flange, the first case further including a pair of splines each extending radially from an outer surface of the annular flange;

the second case having a body including a mating end and a securing end, the body of the second case further including a female section defining the terminus of the mating end, the female section including a sleeve portion having an interior space defined therein that is complementary to the annular flange of the first case to enable the annular flange of the first case to be receivable within the interior space of the sleeve portion, the sleeve portion including a shell body;

the sleeve portion of the second case female section including a pair of channels formed in the shell body thereof, each channel having an axial slot and an associated circumferential slot adjoining the axial slot, the axial slot extending in an axial direction and the circumferential slot extending in a circumferential direction, each axial slot extending from a rim of the sleeve portion, the circumferential slot of one channel and the circumferential slot of the other channel each extending from its respective axial slot in a common angular direction;

the male section of the first case and the female section of the second case having reciprocal complementary configurations enabling registration of the pair of splines within the pair of channels during an operational lock mode of the assembly;

a pair of magnets, one magnet operably disposed in the cavity of the first case body, another magnet operably disposed in the interior space of the sleeve portion of the second case female section and housed in the interior space of the annular flange of the first case male section during the operational lock mode of the assembly;

a first interior compartment disposed at the securing end of the first case body, the first compartment having an opening communicating with an exterior of the first case;

a second interior compartment disposed at the securing end of the second case body, the second compartment having an opening communicating with an exterior of the second case;

a first post disposed in the first compartment of the first case body; and a second post disposed in the second compartment of the second case body.

In another aspect of the invention, an assembly for use in releasably connecting free ends of an item of jewelry comprises:

a first case and a second case;

the first case having a body including a mating end and a securing end, the body of the first case further including a male section disposed at the mating end of the body, the male section including an annular flange having an interior space defined therein and extending from a main section of the body, the first case body having a cavity in communication with the interior space of the annular flange, the first case further including a pair of splines each extending radially from an outer surface of the annular flange;

the second case having a body including a mating end and a securing end, the body of the second case further including a female section defining the terminus of the mating end, the female section including a sleeve portion having an interior space defined therein that is complementary to the annular flange of the first case to enable the annular flange of the first case to be receivable within the interior space of the sleeve portion, the sleeve portion including a shell body;

the sleeve portion of the second case female section including a pair of channels formed in the shell body thereof, each channel having an axial slot and an associated circumferential slot adjoining the axial slot, the axial slot extending in an axial direction and the circumferential slot extending in a circumferential direction, each axial slot extending from a rim of the sleeve portion, the circumferential slot of one channel and the circumferential slot of the other channel each extending from its respective axial slot in a common angular direction;

the male section of the first case and the female section of the second case having reciprocal complementary configurations enabling registration of the pair of splines within the pair of channels during an operational lock mode of the assembly;

a pair of magnets, one magnet operably disposed in the cavity of the first case body, another magnet operably disposed in the interior space of the sleeve portion of the second case female section and housed in the interior space of the annular flange of the first case male section during the operational lock mode of the assembly;

the first case body having an outer end surface defined at the securing end thereof;

the second case body having an outer end surface defined at the securing end thereof; and a pair of hook elements each disposed at a respective one of the outer end surface of the first case body and the outer end surface of the second case body.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
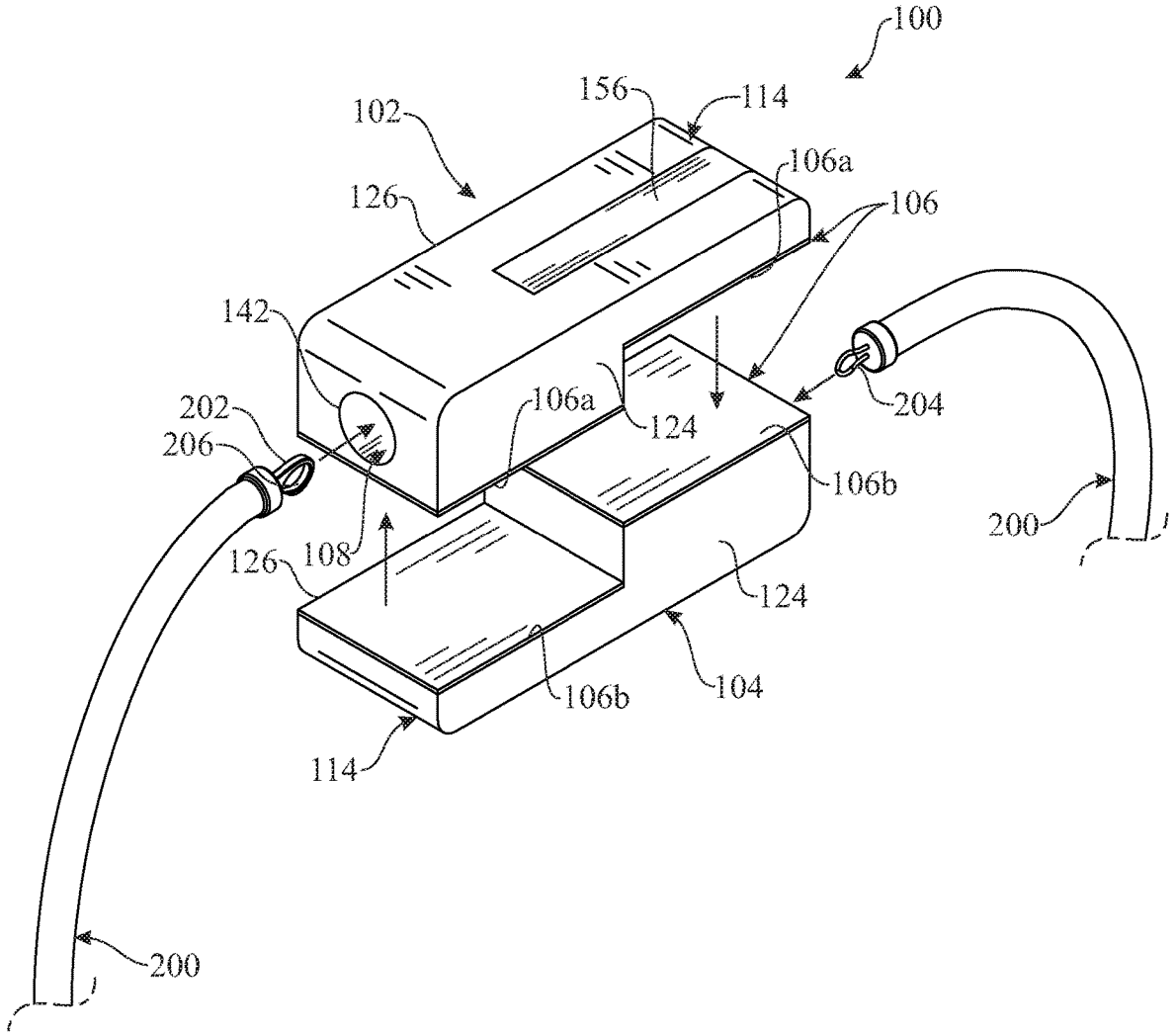
FIG. 1 presents an exploded isometric view of a first exemplary embodiment of a magnetic jewelry attachment assembly in accordance with aspects of the present invention.
Figure 2:
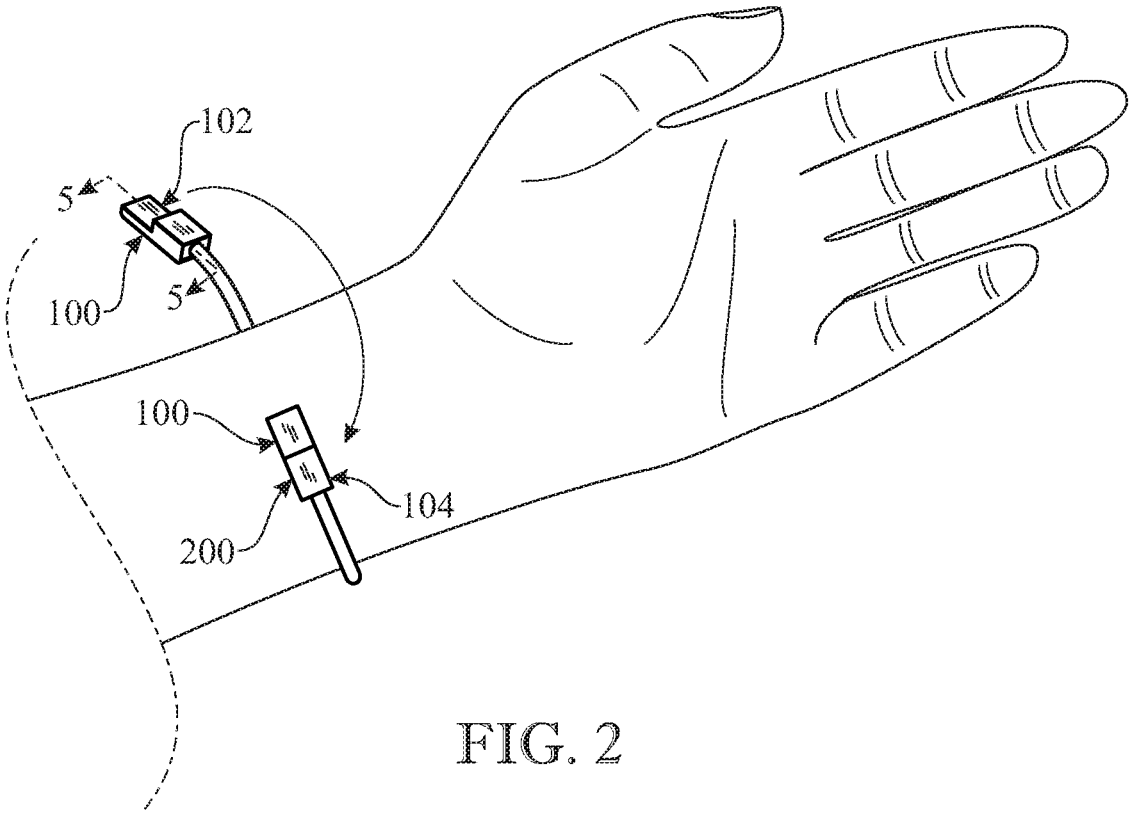
FIG. 2 presents an assembled view on a reduced scale of the attachment assembly originally introduced in FIG. 1, illustrating a pair of magnetically-attractive hollow cases of the attachment assembly before completion of their magnetic mating with one another about the wrist of a user to form a composite magnetic clasp case.
Figure 3:
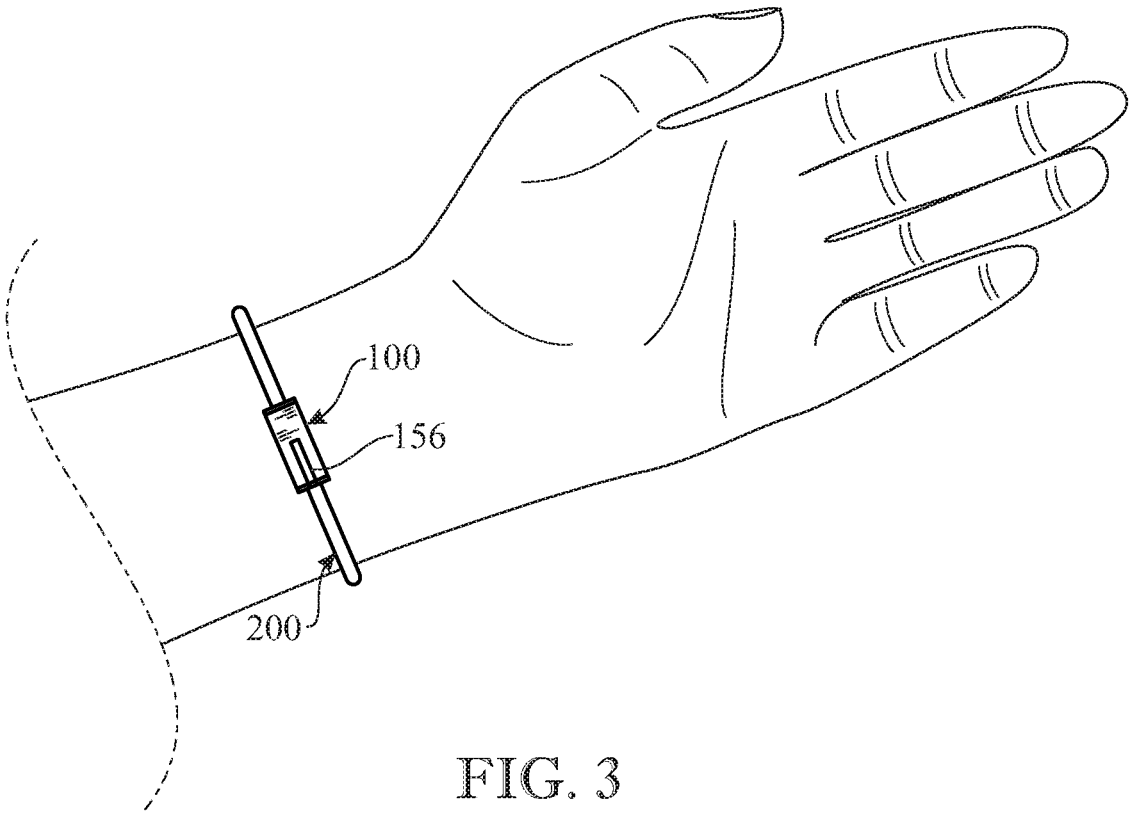
FIG. 3 presents another assembled view of the attachment assembly originally introduced in FIG. 1, illustrating the composite magnetic clasp case formed by the pair of magnetically-attractive hollow cases of the attachment assembly after completion of their magnetic mating with one another about the wrist of the user.

Referring now to FIGS. 1-5, there is illustrated an exemplary embodiment of a magnetic jewelry attachment assembly, generally designated 100, in accordance with aspects of the present invention. As shown in FIG. 1, the magnetic jewelry attachment assembly 100 basically includes a pair of cases 102, 104, a plurality of layers 106 of magnetic material applied on selected portions of the cases, a pair of internal hollow cavities 108 (only one being shown) each formed in, and open at the exterior of, one of the cases in which respective ones of a pair of mechanical clasp components 202, 204 of an item of jewelry 200 can be separately received and hidden from view, and a pair of securement devices 110 (only one of which being shown in FIGS. 4 and 5), each being mounted to one of the cases and biased to extend into and at least partially across an inner end portion 112 of the hollow cavity 108 of a respective one of the cases and being operable to releasably secure one of the mechanical clasp components 202, 204. The cases 102, 104 of the magnetic jewelry attachment assembly 100 have respective constructions and are placed in respective orientations in relation to one another such that when brought together they form a composite magnetic clasp case, as shown in FIGS. 2 and 3.

Figure 5:
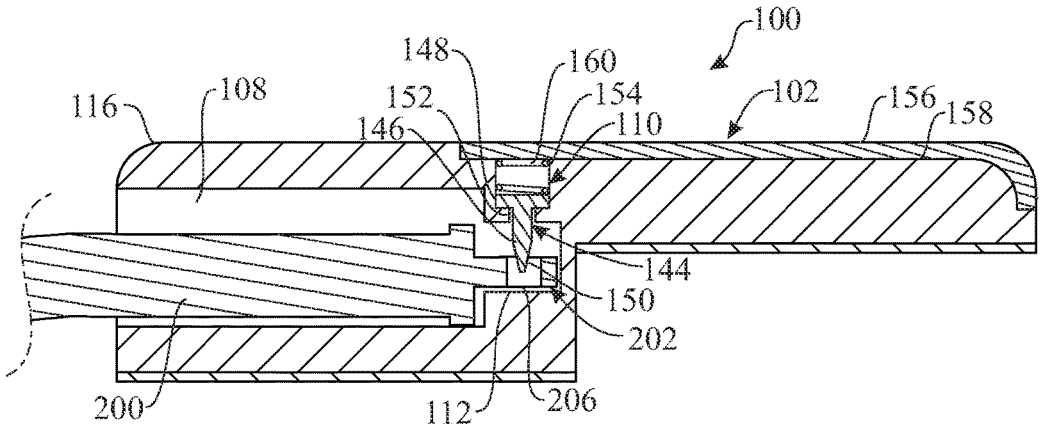
FIG. 5 presents another longitudinal sectional view of the one of the magnetically-attractive hollow cases of the attachment assembly after engagement within the one case of the one of the original mechanical clasp components by the securement device disposed in the one case.
Figure 6:
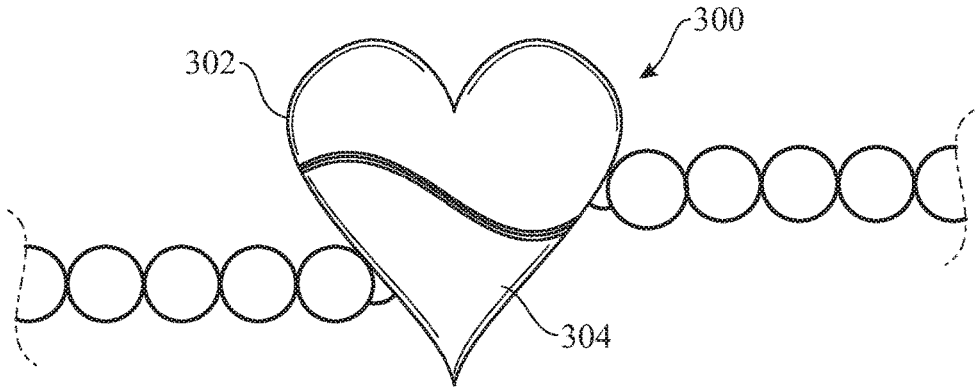
FIG. 6 presents a fragmentary front view of a second exemplary embodiment of a composite magnetic clasp case having one pleasing external ornamental configuration that is formed by a pair of magnetically-engaged hollow magnetized cases of the magnetic jewelry attachment assembly installed on an item of jewelry.
Figure 7:
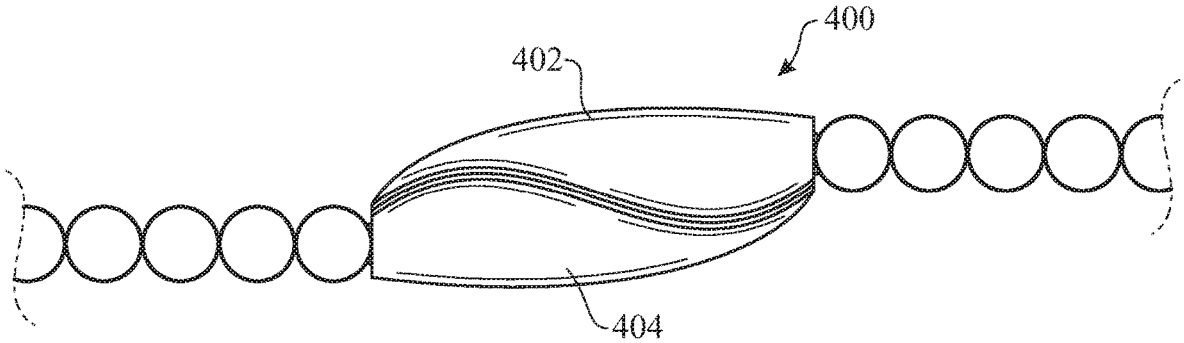
FIG. 7 presents a fragmentary front view of a third exemplary embodiment of a composite magnetic clasp case having another pleasing external ornamental configuration that is formed by a pair of magnetically-engaged hollow magnetized cases of the magnetic jewelry attachment assembly installed on an item of jewelry.

Turning momentarily to FIGS. 6 and 7, there are illustrated two other exemplary embodiments of magnetic jewelry attachment assemblies, generally designated 300, 400, that form composite magnetic clasp cases in accordance with aspects of the present invention. Each of the magnetic jewelry attachment assemblies 300, 400 has a pair of magnetized hollow cases 302, 304 and 402, 404, respectively, with internal hollow cavities (not shown) that separately receive, secure and hide the respective mechanical clasp components (not shown) of the illustrated items of jewelry, such as a bracelet or necklace. Each of the respective magnetic jewelry attachment assemblies 300, 400 has a pleasing external ornamental configuration while still having a construction similar to that of the magnetic jewelry attachment assembly 100 that is described hereinabove with reference to FIGS. 1-5.

More particularly, referring again to FIG. 1, the cases 102, 104 have identical constructions and are placed in relatively inverted orientations with respect to one another and in positions of opposition to one another in which they have been rotated 180° about a common vertical axis with respect to one another. With such identical constructions and relatively inverted and rotated orientations, the cases 102, 104 are respectively formed as elongated bodies 114 having opposing stepped configurations such that the elongated body 114 of the one case 102 has a first pair 106*a* of the layers 106 of magnetic material attached thereon and the elongated body 114 of the other case 104 has a second pair 106*b* of the layers 106 of magnetic material attached thereon. Thus, when the cases 102, 104 are brought close to, and aligned with, one another, as seen in FIG. 1, the first and second pairs of layers 106 of magnetic material on the respective ones of the elongated bodies 114 of the cases 102, 104 magnetically attract one another such that they magnetically mate to form the composite magnetic clasp case.

Figure 4:
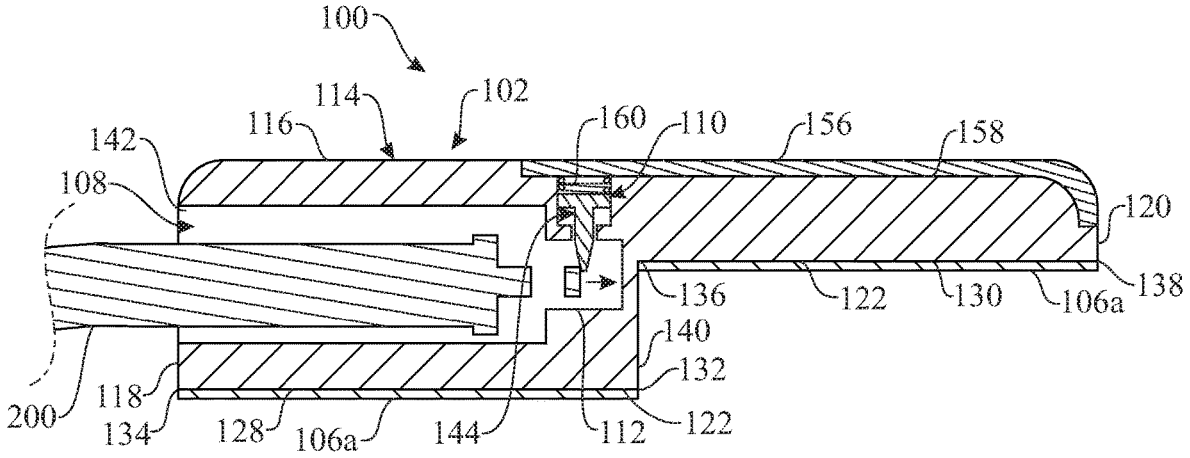
FIG. 4 presents a longitudinal sectional view of one of the magnetically-attractive cases of the attachment assembly before engagement within the one case of one of the original mechanical clasp components by a self-locking and self-releasing securement device disposed in the one case.

Further, as depicted in FIGS. 4 and 5, each securement device 110 is self-locking and self-releasing relative to a respective one of the pair of mechanical clasp components 202, 204 of the item of jewelry 200, when received into the hollow cavity 108 of the respective case 102, 104. Each securement device 110 functions to temporarily retain the one mechanical clasp component 202, 204 in the respective case 102, 104 in absence of a predetermined pulling force applied to the one mechanical clasp component to cause withdrawal of the same from the hollow cavity 108 of the respective case.

More particularly, as shown in FIGS. 1, 4 and 5 in the one exemplary embodiment of the magnetic jewelry attachment assembly 100, the elongated body 114 of each of the cases 102, 104 has an outer surface 116, a pair of opposite outer end surfaces 118, 120, an inner surface 122, and a pair of opposite outer side surfaces 124, 126. The opposite outer end surfaces 118, 120 are spaced apart and extend parallel to one another, between and merging edgewise with the outer and inner surfaces 116, 122. The first outer end surface 116 extends a greater distance from the outer surface 116 than the second outer end surface 118 such that the inner surface 122 is formed by a pair of offset inner surface portions 128, 130 being parallel to one another and spaced apart at different elevations relative to one another and also parallel to, and at different distances from, the outer surface 116. The pair of inner surface portions 128, 130 of the inner surface 122 have respective pairs of opposite end edges 132, 134 and 136, 138 of which first ones 132, 136 of the respective pairs of opposite end edges are spaced proximate to one another and second ones 134, 138 of the respective pairs of opposite end edges are located remote from one another and merge with respective ones of the pair of opposite outer end surfaces 118, 120. The inner surface 122 is also formed by an intermediate inner surface portion 140 extending between and interconnecting the inner surface portions 128, 130 at the first ones 132, 136 of the respective pairs of opposite end edges. The pair of opposite outer side surfaces 124, 126 are spaced apart and extend parallel to one another and merge edge-wise with the outer and inner surfaces 116, 122 and the opposite outer end surfaces 124, 126 such that the opposite outer side surfaces 124, 126 and the inner surface 122 of each case 102, 104 has the stepped configuration of their respective elongated bodies 114 such that the stepped configuration of the one case 102 is the inverse of the stepped configuration of the other case 104. The facing engagement of the transversely-oriented intermediate inner surface portions 140 of the elongated bodies 114 of the cases 102, 104 will resist swiveling and releasing of the cases relative to one another and thus provide a substantially degree of security that the cases will not become disengaged from one another without the intentional application of a substantial amount of pulling force that will overcome the magnetic attraction of the cases with one another.

A first pair 106*a* of the plurality of layers 106 of magnetic material are applied on the respective inner surface portions 128, 130 of the inner surface 122 of the one case 102, and a second pair 106*b* of the plurality of layers 106 of magnetic material are applied on the respective inner surface portions 128, 130 of the inner surface 122 of the other case 104. The first pair of layers 106*a* is magnetically attracted to the second pair of layers 106*b* such that the one case 102 is magnetically attracted to the other case 104 and will magnetically mate together to form the composite magnetic clasp case. The internal hollow cavity 108 formed into each of the elongated bodies 114 of the cases 102, 104, by way of example but not limitation, is of cylindrical shape, open at an outer end 142 of the hollow cavity 108 and the first outer end surface 116 of the elongated body 114, and extends therefrom to proximate to, but short of, the intermediate inner surface portion 140 of the inner surface 122 of the elongated body 114. The inner end portion 112 of the hollow cavity 108, where the securement device 110 is located and into which one of the mechanical clasp components 202, 204 extends, is reduced in diameter compared to the remainder of the hollow cavity.

As best seen in FIGS. 4 and 5, the one of the pair of securement devices 110 being illustrated may take the form of tack-shaped catch element 144 having an shaft 146 on which is rigidly attached an enlarged disk-shaped head 148 at the outer end of the shaft and a tapered end portion 150 at the inner end of the shaft. The shaft 146 extends through an aperture 152 of a recess 154 formed in the elongated body 114 of each case 102, 104 in general diametric alignment with the inner end portion 112 of the interior hollow cavity 108 of the elongated body. An elongated strip 156 of a suitable flexible material is affixed in a groove 158 formed on the outer surface 116 of the elongated body 114 extending from the one opposite outer end surface 120 to the past the recess 154. A coil spring 160 is disposed in the recess 154 between the head 148 of the catch element 144 and an adjacent end portion 162 of the elongated strip 156. The coil spring 160 is biased into engagement with the head 148 of the catch element 144 to normally yieldably hold the catch element with its shaft 146 extended through the aperture 152. Upon insertion of a respective one of the mechanical clasp components 202 through the internal hollow cavity 108 in the elongated body 114 to the inner end portion 112 thereof, a portion of an annular shaped rim 206 of the mechanical clasp component 202 will be brought into engagement with the tapered end portion 150 of the shaft 146, causing the catch element 144 to momentarily retract into the recess 154 against the yieldable bias of the coil spring 160 until the portion of the mechanical clasp component rim 206 passes the shaft tapered end portion of the catch element. Once past, the bias of the coil spring 160 returns, or extends, the shaft tapered end portion of the catch element into the annular shaped rim 206 of the mechanical clasp component 204 such that the mechanical clasp component is retained secured to the one case 102 in absence of a predetermined pulling force applied to the one mechanical clasp component 202 to cause withdrawal of the same from the hollow cavity 108 of the respective case.

To recap, the magnetic jewelry attachment assembly 100 of the present invention allows easy installation to existing jewelry, that is, to any item of jewelry that has a clasp-type lock. The underlying concept is that the existing claw and link end components of the original mechanical clasp are placed in respective magnetically-attractive hollow case bodies, without using any attachment tools, which together form a composite magnetic clasp case which may have a pleasing external ornamental appearance. The magnetically-attractive case bodies hold the respective clasp components separate from one another and hidden from view while magnetic attraction of the case bodies to one another provides a convenient easy way for a wearer to put the item of jewelry on or take it off without using the respective original mechanical clasp components. The attachment assembly 100 is particularly helpful to elderly or those with vision or dexterity issues. The attachment assembly 100 is attractive in and of itself so that it will appeal to younger wearers as well.

Figure 8:
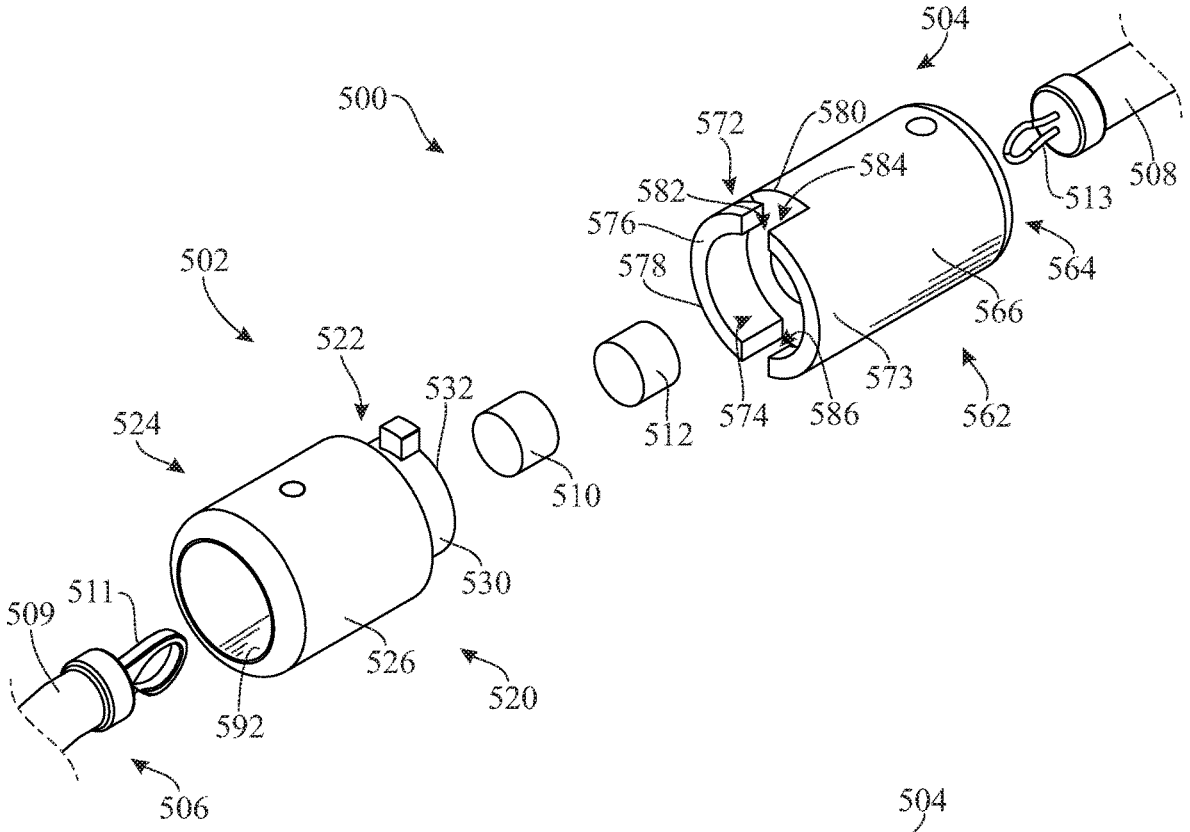
FIG. 8 presents an exploded isometric view of another exemplary embodiment of a jewelry attachment assembly in accordance with aspects of the present invention, shown in juxtaposition to the item of jewelry.

Referring now to FIGS. 8-12, there is illustrated an exemplary embodiment of a jewelry attachment assembly, generally designated 500, in accordance with aspects of the present invention. As shown in FIG. 8, assembly 500 includes, in combination, a first case 502 and a second case 504. In assembled operation, as discussed in more detail, first case 502 and second case 504 are assembled together in a coupling arrangement to form a single integrated unit that facilitates attachment between free ends 506, 508 of an item of jewelry 509, such as a bracelet, necklace, or the like. This coupling between first case 502 and second case 504 employs a releasable connection that enables a quick-release, quick-disconnect action between the first case 502 and second case 504, offering the user an opportunity to readily separate the first case 502 and second case 504 in order, for example, to remove the jewelry item from being worn about the wrist or neck.

Referring more particularly to FIGS. 8-12, the first case 502 includes a body 520 having a mating end 522 and a securing end 524. The mating end 522 and securing end 524 define opposing ends of first case 502. The body 520 has a main section 526 having a generally cylindrical construction. The body 520 includes a male section 530 at the mating end 522. The male section 530 defines a terminus of first case 502 at its mating end 522. The male section 530 includes an annular flange section 532 that extends in an axial direction from the main section 526 of body 520. In other forms, the annular flange section 532 can be considered a ring-shaped member, a washer-shaped member, or a cylindrical male member. The annular flange section 532 has a reduced diameter compared to that of the main section 526 of body 520. The annular flange section 532 defines a central interior space 534. The main section 526 of body 520 has an axially-facing outer end surface or face 540 at the mating end 522 of first case 502. This outer end surface 540 forms a shoulder area between the main body section 526 and the annular flange section 532.

The body 520 of first case 502 further includes an inner cavity space 542 (best shown in FIG. 12) that is disposed immediately axially rearward of the interior space 534 of annular flange section 532. The inner cavity space 542 of body 520 and the interior space 534 defined by annular flange section 532 are contiguous with one another. The assembly 500 includes a first magnet 510 and a second magnet 512 that, as described more fully below, are housed in assembly 500. The first magnet 510 and second magnet 512 have opposite polarities to enable magnetic attraction between them when placed in proximity to one another. The inner cavity space 542 of body 520 is suitably configured (i.e., sized and dimensioned) so that, in the fully assembled operation of assembly 500, the inner cavity space 542 can receive, house, and otherwise accommodate first magnet 510. Likewise, the interior space 534 of annular flange section 532 is suitably configured (i.e., sized and dimensioned) so that, in operation of assembly 500, the interior space 534 can receive and house second magnet 512.

Figure 9:
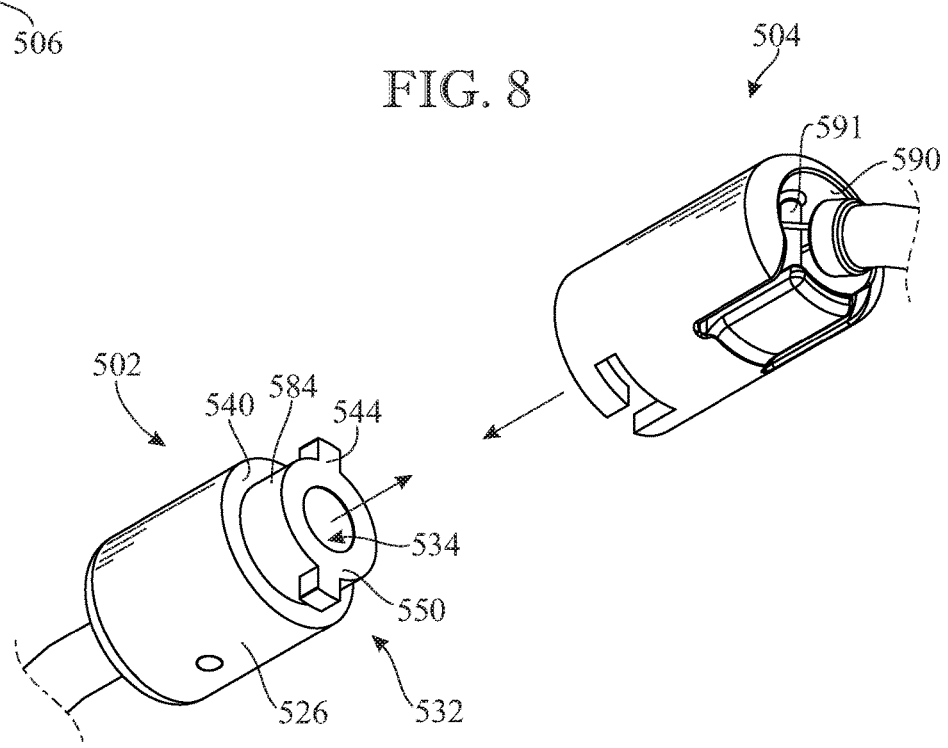
FIG. 9 presents a perspective view of the jewelry attachment assembly originally introduced in FIG. 8, depicting the cases in attachment to free ends of the item of jewelry via a securing mechanism disposed at an interior location of the cases according to one aspect of the invention, and further showing the orientation of the cases as they are being staged immediately prior to joining them along the indicated line.
Figure 10:
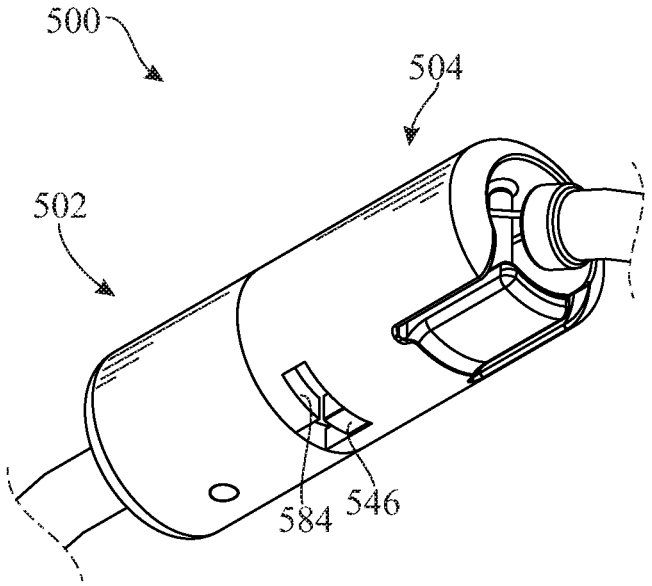
FIG. 10 presents a lower perspective view of the assembly originally introduced in FIG. 8, illustrating how the pair of cases are joined in a partially assembled configuration depicting an unlocked position, and noting the orientation of a spline poised for entry into the circumferential slot.

The male section 530 at mating end 522 of first case 502 further includes a pair of splines 544, 546 projecting radially from an outer annular surface or periphery 548 of annular flange section 532 (as best shown in FIG. 9). In other forms, the pair of splines 544, 546 can be considered a key member, projection element, a raised/elevated portion, fitting, and ridge. In one illustrative form, the splines 544, 546 have a generally rectangular formation. The pair of splines 544, 546 are positioned at the most axially forward location possible on annular surface 548 of annular flange section 532 so that the axially facing surface of the splines 544, 546 is coplanar with the axially facing surface 550 of annular flange section 532. In one illustrative form, the pair of splines 544, 546 are located at diametrically opposite locations about annular flange section 532.

The second case 504 includes a body 560 having a mating end 562 and a securing end 564. The mating end 562 and securing end 564 define opposing ends of second case 504. The body 560 has a main section 566 having a generally cylindrical or tubular construction. The body 560 includes a female section 570 at the mating end 562. The female section 570 defines a terminus of second case 504 at its mating end 562. The female section 570 includes a sleeve portion 572 having an interior space 574. The sleeve portion 572 includes an axially facing outer end surface or face 576 defined at a rim 578 of sleeve portion 572. The sleeve portion 572 includes a generally cylindrical or tubular body having a shell or casing 573.

The sleeve portion 572 includes a pair of channels 580, 581 formed in shell 573 of sleeve portion 572. Each one of the pair of channels 580, 581 defines a respective axial slot 582 and an associated circumferential slot 584. The axial slot 582 and its associated circumferential slot 584 are contiguous with one another. In particular, axial slot 582 and its associated circumferential slot 584 are arranged in communication with one another. The axial slot 582 extends in an axial dimension of shell 573 and circumferential slot 584 extends in a circumferential dimension about shell 573. The axial slot 582 and its paired, associated circumferential slot 584 adjoin one another. The axial slot 582 has an opening 586 at the rim 578 of sleeve portion 572. In particular, the outer end surface 576 of sleeve portion 572 is discontinuous at two locations along rim 578, where a pair of gaps or interstices are formed at rim 578 to define the opening 586 of axial slot 582 of each channel 580, 581. In one form, the pair of axial slots 582 of the pair of channels 580, 581 are disposed diametrically opposite one another.

In other forms, each one of the pair of channels 580, 581 can be considered a passageway, guideway, keyway, cleft, or incision formed in the shell 573 of sleeve portion 572. In other forms, the gap-like openings 586 make sleeve portion 572 have a split-ring construction. The respective circumferential slot 584 of each one of the pair of channels 580, 581 extends from its respective axial slot 582 in a common angular direction. For example, viewing second case 504 along a longitudinal direction from mating end 562 to securing end 564, the circumferential slot 584 extends in a counter-clockwise direction from its associated axial slot 582. The pair of channels 580, 581 are configured with the same dimensions.

Turning now to the assembled arrangement of assembly 500, reference is again made to FIGS. 8-12. Prior to the assembled coupling of first case 502 and second case 504, first magnet 510 is disposed in the interior cavity space 542 of first case 502. In one form, a suitable means is provided to fixedly secure first magnet 510 in the interior cavity space 542 of first case 502. Additionally, second magnet 512 is disposed in the interior space 574 defined by sleeve portion 572 of the female section 570 of second case 504. In one form, a suitable means is provided to fixedly secure second magnet 512 within the female section 570 of second case 504.

Next, the first case 502 and second case 504 are brought into alignment with one another such that the pair of splines 544, 546 of annular flange section 532 of first case 502 align with respective axial slots 582 of the pair of channels 580, 581 of sleeve portion 572 of second case 504. Once this aligned orientation is established, relative axial movement or displacement is effected between first case 502 and second case 504 in order to facilitate simultaneous entry of the pair of splines 544, 546 into respective axial slots 582 of the pair of channels 580, 581 via respective entrances or openings 586 of axial slots 582. Following this entry action, continued relative displacement between first case 502 and second case 504 (i.e., first case 502 and second case 504 are moved toward one another) causes the pair of splines 544, 546 to be slidingly guided through the respective axial slots 582 of the pair of channels 580, 581. This guided axial movement of the pair of splines 544, 546 is continued until the pair of splines 544, 546 becomes fully accessible to the circumferential slot 584 of its associated axial slot 582. In this configuration, shown in FIG. 10, the assembly 500 is in an unlocked position. At this point, relative rotary movement between first case 502 and second case 504 is effected in order to rotationally displace the pair of splines 544, 546 through the respective circumferential slot 584 of the pair of channels 580, 581. This rotary movement is continued until the pair of splines 544, 546 abut against the terminus of the respective circumferential slot 584. In this configuration, shown in FIG. 11, the assembly 500 is in a locked position. In this locked position, the pair of splines 544, 546 of first case 502 are registered within the pair of channels 580, 581 of second case 504 at respective ones of the circumferential slots 584.

Figure 12:
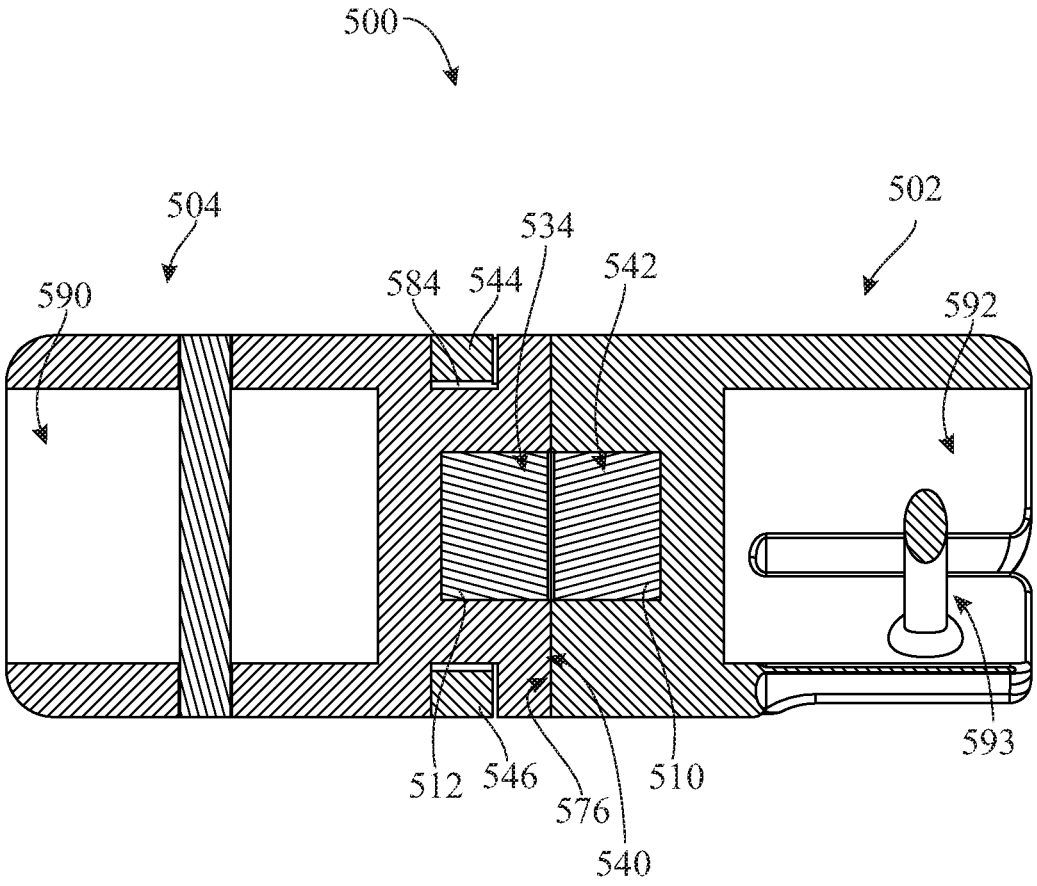
FIG. 12 presents a longitudinal sectional view of the fully assembled configuration shown in FIG. 11, illustrating the proximate relationship of the magnets housed in each case.

At the same time that the pair of splines 544, 546 of first case 502 are traversing through the pair of channels 580, 581 of second case 504 to achieve the interlock between first case 502 and second case 504, the annular flange section 532 of the male section 530 at mating end 522 of first case 502 is entering and becoming situated within the interior space 574 defined by sleeve portion 572 of the female section 570 of second case 504. In this manner, second magnet 512 that is positioned within the second case 504 becomes housed within the interior space 534 of annular flange section 532. As best shown in FIG. 12, the locked position of assembly 500 is characterized by an adjacent relationship between first magnet 510 (housed in the inner cavity space of first case 502) and second magnet 512 (housed in the interior space 534 of annular flange section 532, which is now positioned in the female section 570 of second case 504). This proximity between first magnet 510 and second magnet 512 facilitates a magnetic coupling between first case 502 and second case 504 to promote tight engagement between them. The magnetic attraction between first magnet 510 and second magnet 512 urges the first case 502 and second case 504 towards one another and helps to maintain the assembly 500 in its locked position by resisting any rotational activity that tends to unlock the assembly 500.

Figure 11:
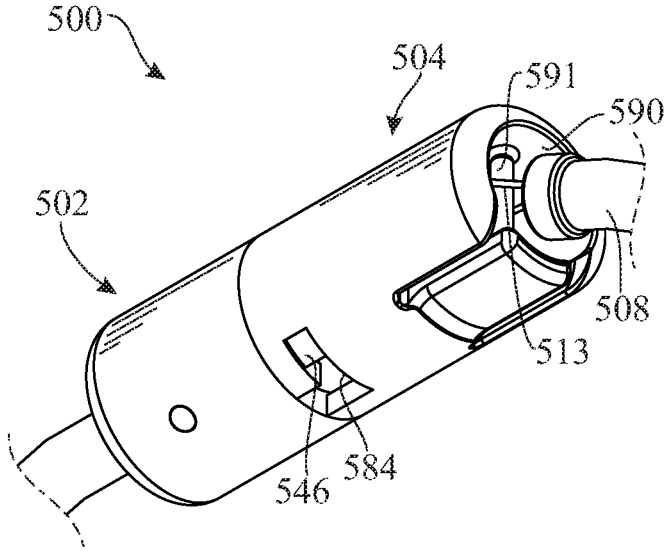
FIG. 11 presents a lower perspective view of the assembly originally introduced in FIG. 8, illustrating how the pair of cases are joined in a fully assembled configuration depicting a locked position that ensues by advancing from the unlocked position of FIG. 10, and noting the orientation of a spline fully registered in the circumferential slot.

In the locked position of assembly 500, best shown in FIGS. 11 and 12, there is a butt-type engagement between first case 502 and second case 504. In particular, as shown in FIG. 12, the axially-facing outer end surface 540 at the mating end 522 of first case 502 is disposed in facing opposition to the axially-facing outer end surface 576 defined at the rim 578 of sleeve portion 572 of second case 504. In one form, assembly 500 is suitably configured to enable a surface-to-surface contact engagement between end surface 540 of first case 502 and end surface 576 of second case 504.

For the purpose of facilitating the interlock arrangement between first case 502 and second case 504, the male section 530 at mating end 522 of first case 502 and the female section 570 at the mating end 562 of second case 504 are complementary to one another so that the respective cases can be mated together. As a result, first case 502 and second case 504 are counterparts to one another. For example, the pair of channels 580, 581 formed in shell 573 of sleeve portion 572 of second case 504 are suitably configured to receive and accommodate the pair of splines 544, 546 of first case 502. The annular flange section 532 disposed at the mating end 522 of first case 502 is suitably configured to enable it to be received within the interior space 574 of sleeve portion 572 at the mating end 562 of second case 504, while at the same time enabling proper registration of the pair of splines 544, 546 within the pair of channels 580, 581 formed in shell 573 of sleeve portion 572 of second case 504. In one form, the body 520 of first case 502 and the body 560 of second case 504 are suitably configured so that when the first case 502 and second case 504 are joined together in their interlocking arrangement, the first case 502 and second case 504 are flush with one another, making it appear that assembly 500 has a single, continuous construction.

The assembly 500, once maneuvered into its locked position, can be unlocked by reversing the movements used to originally lock the assembly 500. In particular, relative rotation between first case 502 and second case 504 is initially completed, followed by withdrawal of the first case 502 from the second case 504 by pulling them apart along a longitudinal axis of the assembly 500. The magnetic coupling afforded by the combination of first magnet 510 and second magnet 512 can be overcome using a modest level of effort. The first magnet 510 and second magnet 512 can be selected with a view towards providing different levels of coupling strength delivered by the magnetic attraction.

Referring again to FIGS. 8-9 and 12, assembly 500 is furnished with a means to secure the assembly 500 to free ends 506, 508 of an item of jewelry 509 worn by a user. According to one aspect of the invention, second case 504 includes an open-ended compartment 590 disposed at the securing end 564 of second case 504. The open-ended feature of compartment 590 enables access into compartment 590 from outside second case 504. Compartment 590 includes a post 591 disposed at an interior location within compartment 590, yet readily accessible to the user. In one form, post 591 has a vertical, elongate construction that is oriented in an upright position. Likewise, first case 502 includes an open-ended compartment 592 disposed at the securing end 524 of first case 502, which can be accessible from outside first case 502. Compartment 592 includes a post 593 disposed at an interior location within compartment 592. The item of jewelry 509 includes a clasp 511 disposed at its free end 506 and a clasp 513 disposed at its free end 508. The clasps 511, 513 have a conventional design and can be provided in typical forms such as a hook or loop. In operation, the user maneuvers clasp 511 into position within compartment 592 of first case 502 and hooks clasp 511 over post 593, as best shown in FIG. 12. Likewise, the user maneuvers clasp 513 into position within compartment 590 of second case 504 and hooks clasp 513 over post 591, as best shown in FIG. 9. These hook-type connections enable the item of jewelry 509 to be removably secured and otherwise attached to assembly 500. The item of jewelry 509 can be released from this temporary connection with assembly 500 by unhooking clasps 511, 513 from their respective posts 593, 591. Although posts 591, 593 are disclosed, other suitable structures are possible that enable a secure connection to the hook-type arrangement of jewelry clasps 511, 513.

Figure 13:
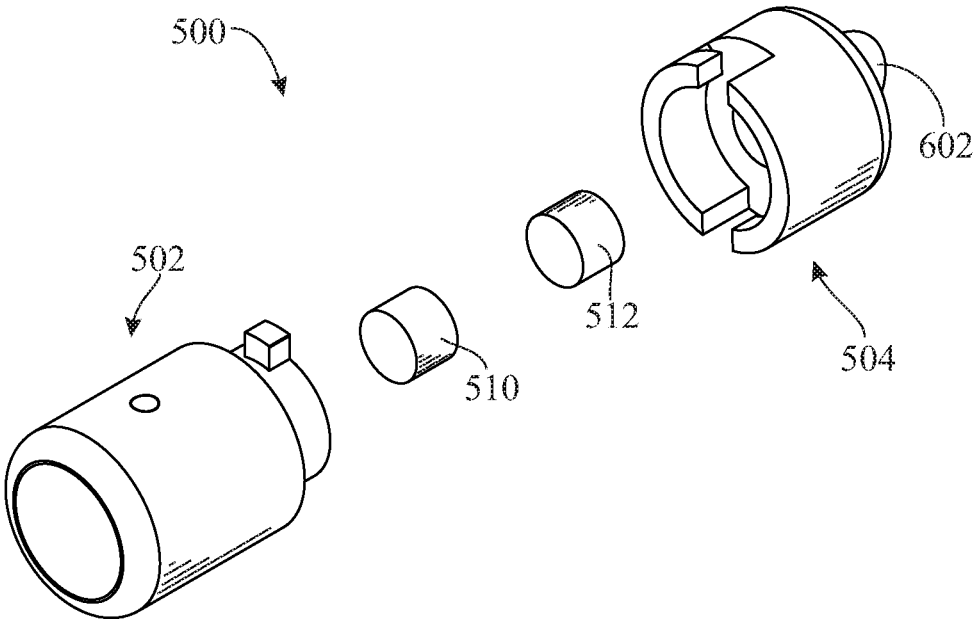
FIG. 13 presents an exploded isometric view of a jewelry attachment assembly similar to that disclosed in FIG. 8, illustrating in partial view a securing mechanism disposed at an exterior location of the cases for attaching free ends of the jewelry item to the assembly according to another aspect of the invention.
Figure 14:
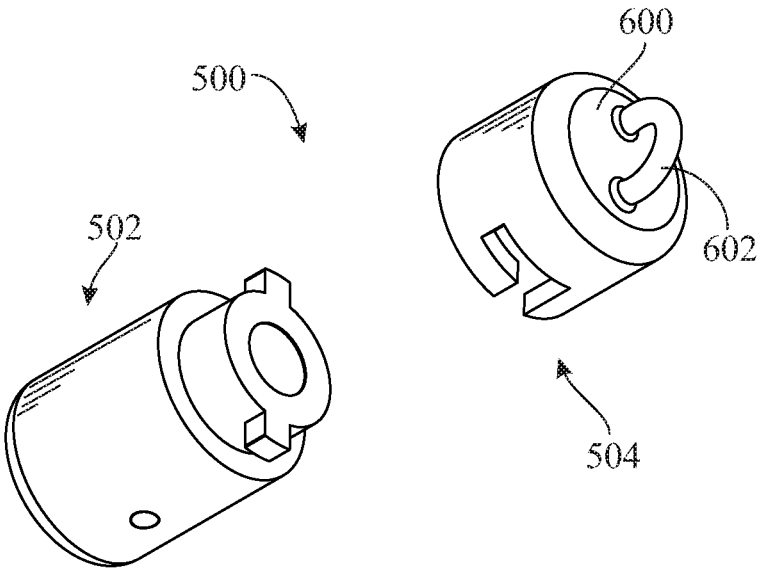
FIG. 14 presents a perspective view of the jewelry attachment assembly originally introduced in FIG. 13, showing the jewelry securing mechanism in full view.

Referring now to FIGS. 13-14, another mechanism is set forth that secures the item of jewelry 509 to assembly 500, according to another aspect of the invention. The second case 504 is closed at its securing end 564 by an end cap, lid, or other suitable structure 602. The second case 504 includes an exterior hook 602 attached to end cap 600. The first case 502 is likewise equipped at its securing end 524 by a hook (not shown) attached to an end cap (not shown). The item of jewelry 509 is fitted at its free ends with a pair of linking devices (not shown) that facilitate a temporary, releasable connection between the item of jewelry 509 and assembly 500. For example, these linking devices can have a carabiner-style construction including, in one form, a loop with a spring-loaded gate that allows the user to clip or latch the item of jewelry 509 onto the pair of securing hooks 602 at opposite ends of assembly 500 in its locked configuration. The user can quickly and reversibly disconnect the components by unlatching, unclipping, or otherwise unfastening the linking devices from the securing hooks 602.

The assembly 500 provides a set of independent features for maintaining an adjustable and temporary connection or linkage between the free ends of an item of jewelry. One feature involves the releasable and reversible interlocking arrangement between the first case 502 and second case 504 of assembly 500. The interlocking joint, which is facilitated by the rotary coupling of first case 502 to second case 504 via the registration of a pair of splines (male components) to a pair of complementary channels having axial and circumferential slots (female components), offers a sturdy and reliable connection that resists inadvertent efforts to disconnect or dislodge the cases from their locked position. Because jewelry worn about the neck or wrist typically has a measure of slack to aid comfort (i.e., hangs loosely), the jewelry can easily catch on objects having angled or projecting features. If the user is unaware, movements of the hands, for example, can cause the caught object to yank or pull on the item of jewelry, such as a bracelet. However, because the connection between first case 502 and second case 504 has a rotary-style lock, the first case 502 and second case 504 remain joined together despite the longitudinal pulling action. Additionally, another feature of assembly 500 that facilitates linkage between first case 502 and second case 504 involves the magnetic attraction between the pair of magnets housed in first case 502 and second case 504. The magnetic action exerts a force in the longitudinal direction of assembly 500 that tends to press or urge the first case 502 and second case 504 together. In this manner, the pair of magnets helps to stabilize the locked position of first case 502 and second case 504 in both the axial and rotational directions. For example, any rotary forces experienced by either first case 502 or second case 504 can be resisted by the magnetic attraction between the pair of magnets. The magnetic attraction acts in the axial or longitudinal dimension of assembly 500, enabling the first case 502 and second case 504 to be urged into tight engagement with one another, which can help close out any axial spaces or clearances between the mating ends of the cases. Once joined, the first case 502 and second case 504 form a composite, integral arrangement.

The composite packaging of the first case 502 and the second case 504 benefits from the male-female coupling employed by assembly 500. In particular, during assembly, the male section of first case 502 is joined to the female section of the second case 504 by registration of the pair of splines within the pair of circumferential slots by first guiding the splines through the axial slots, then guiding the splines through the circumferential slots. The ensuing configuration represents a locked condition of assembly 500 that is stable and secure, yet permits convenient release and reversibility to enable the user to readily disconnect the cases and remove the jewelry item.

Additionally, assembly 500 provides various means to fasten the item of jewelry to the assembled cases. In one form, the free ends of the jewelry item are hooked over a pair of interior posts each situated, generally out of view, within rearward compartments of each case that the user can access via the open-ended structure of the compartment. Alternately, the securing ends of the cases are fitted with exterior hooks located on the outside of the case. The free ends of the jewelry item can be fastened to these exterior hooks. Once the pair of cases are assembled (i.e., the pair of splines are registered within the circumferential slots of the pair of channels), and the free ends of the jewelry item are attached to the securing ends of the cases, a closed loop is formed that secures the jewelry item to the wearer.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

What is claimed is:

1. A magnetic jewelry attachment assembly for selectively coupling mechanical clasps at opposite free ends of an article of jewelry, the magnetic jewelry attachment assembly comprising:

a magnetized first clasp case, comprising:

a first elongated clasp case body incorporating a first clasp-receiving cavity extending into a clasp-receiving end thereof, the first clasp-receiving cavity oriented along a longitudinal axis of said first elongated clasp case body, the first elongated clasp case body having a male configuration disposed at a mating end of the first elongated clasp case body, the male configuration in the form of an annular boss protruding from an end surface at the mating end of the first elongated clasp case body and defining a mating end central opening in communication with said first clasp-receiving cavity, the first elongated clasp case body having a pair of radially-offset splines extending radially outward from a circumferential outer surface of the annular boss; and a first clasp securement device integrated into an inner end portion of the first clasp-receiving cavity, wherein said first clasp securement device is configured to engage a first one of the mechanical clasps at a first one of the opposite free ends of the article of jewelry; and a magnetized second clasp case, comprising:

a second elongated clasp case body incorporating a second clasp-receiving cavity extending into a clasp-receiving end thereof, the second clasp-receiving cavity oriented along a longitudinal axis of said second elongated clasp case body, the second elongated clasp case body having a female configuration defining a terminus of a mating end of the second elongated clasp case body, the female configuration including a sleeve portion defining a sleeve portion interior space that is geometrically complementary to the annular boss and radially-offset splines of the first elongated clasp case body to enable the annular boss and radially-offset splines of the first elongated clasp case body to be seated within the interior space of the sleeve portion, the sleeve portion interior space communicative with a magnet retaining cavity extending into the mating end of the second elongated clasp case body, the sleeve portion of the second elongated clasp case body female configuration defining a pair of channels provided therein, each one of the pair of channels having a linearly disposed axial slot length and an associated radially disposed circumferential slot length contiguous with the axial slot length, the axial slot length extending in an axial direction parallel to the central axis of the second elongated clasp case body, and the circumferential slot length extending in a circumferential direction about the central axis of the second elongated clasp case body, each of the axial slot lengths extending from a rim of the sleeve portion, the circumferential slot length of one of said pair of channels and the circumferential slot length of the other one of said pair of channels each extending from its respective axial slot length along a common plane perpendicular to the central axis of the second elongated clasp case body; and a second clasp securement device integrated into an inner end portion of the second clasp-receiving cavity, wherein said second clasp securement device is configured to engage a second one of the mechanical clasps at a second one of the opposite free ends of the article of jewelry, wherein: the male configuration of the first elongated clasp case body and the female configuration of the second elongated clasp case body have reciprocal complementary configurations enabling registration of the pair of splines within the respective pair of channels during a reversible operational lock mode of the assembly, and a first one of a pair of magnets is operably disposed in the mating end central opening of the first elongated clasp case body, and a second one of the pair of magnets is operably disposed in the magnet retaining cavity extending into the mating end of the second elongated clasp case body, such that the first and second magnetized clasp cases structurally and magnetically mate with one another to form a composite magnetic clasp encasement.

2. The magnetic jewelry attachment assembly of claim 1, further comprising:

a first interior compartment disposed at the clasp-receiving end of the first elongated clasp case body, the first interior compartment having an opening communicating with an exterior of the first elongated clasp case body;

a second interior compartment disposed at the clasp-receiving end of the second elongated clasp case body, the second compartment having an opening communicating with an exterior of the second elongated clasp case body;

a first post disposed in the first compartment of the first elongated clasp case body; and a second post disposed in the second compartment of the second elongated clasp case body.

3. The magnetic jewelry attachment assembly of claim 2, wherein, during use, the mechanical clasps disposed at respective free ends of the article of jewelry are each maneuvered into a respective one of the first compartment and the second compartment via the opening thereof, and releasably fastened to a respective one of the first post and the second post during operation of the assembly.

4. The magnetic jewelry attachment assembly of claim 1, further comprising:

a first interior compartment disposed at the clasp-receiving end of the first elongated clasp case body, the first compartment having an opening communicating with an exterior of the first elongated clasp case body; and a second interior compartment disposed at the clasp-receiving end of the second elongated clasp case body, the second compartment having an opening communicating with an exterior of the second elongated clasp case body, wherein the first clasp securement device is disposed in the first compartment of the first elongated clasp case body, the first clasp securement device configured to enable a releasable securing connection with a fastening element disposed at one of the opposite free ends of the article of jewelry, and wherein the second clasp securement device is disposed in the second compartment of the second elongated clasp case body, the second clasp securement device configured to enable a releasable securing connection with a fastening element disposed at the other one of the opposite free ends of the article of jewelry.

5. The magnetic jewelry attachment assembly of claim 1, further comprising:

an outer end surface defined at the clasp-receiving end of the first elongated clasp case body;

an outer end surface defined at the clasp-receiving end of the second elongated clasp case body; and a pair of hook elements each disposed at a respective one of the outer end surface of the first elongated clasp case body and the outer end surface of the second elongated clasp case body.

6. The magnetic jewelry attachment assembly of claim 5, wherein each of the mechanical clasps at opposite free ends of the article of jewelry is releasably fastened to a respective one of the pair of hook elements during operation of the assembly.

7. The magnetic jewelry attachment assembly of claim 1, wherein the registration of the pair of splines within the pair of channels involves alignment of the pair of splines with the pair of channels, relative axial displacement between the first elongated clasp case body and the second elongated clasp case body to situate the pair of splines within the axial slots of the pair of channels, and relative rotation between the first elongated clasp case body and the second elongated clasp case body to situate the pair of splines within the circumferential slots of the pair of channels.

8. The magnetic jewelry attachment assembly of claim 1, wherein each one of the pair of splines is disposed generally diametrically opposite the other one of the pair of splines about a periphery of the annular boss of the male configuration of the first elongated clasp case body.

9. The magnetic jewelry attachment assembly of claim 8, wherein each one of the pair of channels is disposed generally diametrically opposite the other one of the pair of channels about a periphery of the sleeve portion of the female configuration of the second elongated clasp case body.

10. An assembly for use in releasably connecting free ends of an item of jewelry, comprising:

a first case and a second case;

the first case having a body including a mating end and a securing end, the body of the first case further including a male section disposed at the mating end of the body, the male section including an annular flange having an interior space defined therein and extending from a main section of the body, the first case body having a cavity in communication with the interior space of the annular flange, the first case further including a pair of splines each extending radially from an outer surface of the annular flange;

the second case having a body including a mating end and a securing end, the body of the second case further including a female section defining the terminus of the mating end, the female section including a sleeve portion having an interior space defined therein that is complementary to the annular flange of the first case to enable the annular flange of the first case to be receivable within the interior space of the sleeve portion, the sleeve portion including a shell body;

the sleeve portion of the second case female section including a pair of channels formed in the shell body thereof, each channel having an axial slot and an associated circumferential slot adjoining the axial slot, the axial slot extending in an axial direction and the circumferential slot extending in a circumferential direction, each axial slot extending from a rim of the sleeve portion, the circumferential slot of one channel and the circumferential slot of the other channel each extending from its respective axial slot in a common angular direction;

the male section of the first case and the female section of the second case having reciprocal complementary configurations enabling registration of the pair of splines within the pair of channels during an operational lock mode of the assembly;

a pair of magnets, one magnet operably disposed in the cavity of the first case body, another magnet operably disposed in the interior space of the sleeve portion of the second case female section and housed in the interior space of the annular flange of the first case male section during the operational lock mode of the assembly;

a first interior compartment disposed at the securing end of the first case body, the first compartment having an opening communicating with an exterior of the first case;

a second interior compartment disposed at the securing end of the second case body, the second compartment having an opening communicating with an exterior of the second case;

a first post disposed in the first compartment of the first case body; and a second post disposed in the second compartment of the second case body.

11. The assembly of claim 10, wherein the item of jewelry includes a pair of clasps each disposed at a respective free end of the jewelry item, each clasp maneuvered into a respective one of the first compartment and the second compartment via the opening thereof and releasably fastened to a respective one of the first post and the second post during operation of the assembly.

12. The assembly of claim 10, wherein:

the first case body having a generally cylindrical construction, the annular flange of the male section radially narrower than the main section of the first case body, the first case body having an axially facing outer end surface adjacent the annular flange at the mating end of the first case body;

the second case body having a generally cylindrical construction, the second case body having an axially facing outer end surface defined at the rim of the sleeve portion of the second case female section; and in the operational lock mode of the assembly, the axially facing outer end surface of the first case body and the axially facing outer end surface of the second case body are disposed in facing opposition to one another.

13. The assembly of claim 10, wherein the registration of the pair of splines within the pair of channels involves alignment of the pair of splines with the pair of channels, relative axial displacement between the first case and the second case to situate the pair of splines within the axial slots of the pair of channels, and relative rotation between the first case and the second case to situate the pair of splines within the circumferential slots of the pair of channels.

14. The assembly of claim 10, wherein each one of the pair of splines is disposed generally diametrically opposite the other about a periphery of the annular flange of the male section of the first case.

15. An assembly for use in releasably connecting free ends of an item of jewelry, comprising:

a first case and a second case;

the first case having a body including a mating end and a securing end, the body of the first case further including a male section disposed at the mating end of the body, the male section including an annular flange having an interior space defined therein and extending from a main section of the body, the first case body having a cavity in communication with the interior space of the annular flange, the first case further including a pair of splines each extending radially from an outer surface of the annular flange;

the second case having a body including a mating end and a securing end, the body of the second case further including a female section defining the terminus of the mating end, the female section including a sleeve portion having an interior space defined therein that is complementary to the annular flange of the first case to enable the annular flange of the first case to be receivable within the interior space of the sleeve portion, the sleeve portion including a shell body;

the sleeve portion of the second case female section including a pair of channels formed in the shell body thereof, each channel having an axial slot and an associated circumferential slot adjoining the axial slot, the axial slot extending in an axial direction and the circumferential slot extending in a circumferential direction, each axial slot extending from a rim of the sleeve portion, the circumferential slot of one channel and the circumferential slot of the other channel each extending from its respective axial slot in a common angular direction;

the male section of the first case and the female section of the second case having reciprocal complementary configurations enabling registration of the pair of splines within the pair of channels during an operational lock mode of the assembly;

a pair of magnets, one magnet operably disposed in the cavity of the first case body, another magnet operably disposed in the interior space of the sleeve portion of the second case female section and housed in the interior space of the annular flange of the first case male section during the operational lock mode of the assembly;

the first case body having an outer end surface defined at the securing end thereof;

the second case body having an outer end surface defined at the securing end thereof; and a pair of hook elements each disposed at a respective one of the outer end surface of the first case body and the outer end surface of the second case body.

16. The assembly of claim 15, wherein the item of jewelry includes a pair of clasps each disposed at a respective free end of the jewelry item, each clasp releasably fastened to a respective one of the pair of hook elements during operation of the assembly.

17. The assembly of claim 15, wherein:

the first case body has a generally cylindrical construction, the annular flange of the male section radially narrower than the main section of the first case body, the first case body having an axially facing outer end surface adjacent the annular flange at the mating end of the first case body;

the second case body has a generally cylindrical construction, the second case body having an axially facing outer end surface defined at the rim of the sleeve portion of the second case female section; and in the operational lock mode of the assembly, the axially facing outer end surface of the first case body and the axially facing outer end surface of the second case body are disposed in facing opposition to one another.

18. The assembly of claim 15, wherein the registration of the pair of splines within the pair of channels involves alignment of the pair of splines with the pair of channels, relative axial displacement between the first case and the second case to situate the pair of splines within the axial slots of the pair of channels, and relative rotation between the first case and the second case to situate the pair of splines within the circumferential slots of the pair of channels.

19. The assembly of claim 15, wherein each one of the pair of splines is disposed generally diametrically opposite the other one of the pair of splines about a periphery of the annular flange of the male section of the first case.

* * * * *